US009728871B1

(12) United States Patent
Gutgold et al.

(10) Patent No.: US 9,728,871 B1
(45) Date of Patent: Aug. 8, 2017

(54) ELECTRICAL CONNECTOR HAVING A DUAL-ACTUATED RELEASABLE LATCH

(71) Applicant: TYCO ELECTRONICS CORPORATION, Berwyn, PA (US)

(72) Inventors: Glen Gutgold, Harrisburg, PA (US); Tracy Lee Smith, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/212,891

(22) Filed: Jul. 18, 2016

(51) Int. Cl.

| | |
|---|---|
| ***H01R 13/627*** | (2006.01) |
| ***H01R 12/71*** | (2011.01) |
| ***H01R 12/51*** | (2011.01) |
| ***H01R 12/52*** | (2011.01) |
| ***H01R 12/70*** | (2011.01) |

(52) U.S. Cl.
CPC ..... *H01R 12/71* (2013.01); *H01R 12/515* (2013.01); *H01R 12/52* (2013.01); *H01R 12/7011* (2013.01)

(58) Field of Classification Search
CPC ..... H01R 13/6271; H01R 13/6275
USPC ..... 439/352, 344
See application file for complete search history.

(56) References Cited

U.S. PATENT DOCUMENTS

| | | | | |
|---|---|---|---|---|
| 8,231,400 | B2 | 7/2012 | Phillips et al. | |
| 8,388,367 | B2 * | 3/2013 | Nonen | H01R 13/6271 439/352 |
| 8,636,544 | B1 | 1/2014 | Briant et al. | |
| 8,905,777 | B2 * | 12/2014 | Zhu | H01R 13/62 439/352 |
| 9,287,660 | B2 | 3/2016 | Henry et al. | |
| 2012/0088392 | A1 * | 4/2012 | Wagner | H01R 13/5812 439/352 |
| 2012/0208391 | A1 * | 8/2012 | Reed | H01R 13/6275 439/352 |

* cited by examiner

*Primary Examiner* — Phuong Dinh

(57) ABSTRACT

An electrical connector includes a housing having a mating end, a rear end opposite the mating end, and an exterior wall extending at least partially between the mating end and the rear end. The exterior wall includes a cavity with a latch held on the housing at least partially received in the cavity and a latch actuator at least partially received in the cavity. The latch actuator has first and second release mechanisms. The first release mechanism includes a pull tab being linearly movable within the cavity during a pull release operation, and the second release mechanism includes a push button being movable within the cavity during a push release operation for interacting with the latch to release the latch during the push release operation.

20 Claims, 3 Drawing Sheets

ELECTRICAL CONNECTOR HAVING A DUAL-ACTUATED RELEASABLE LATCH

BACKGROUND OF THE INVENTION

The subject matter herein relates generally to electrical connectors having a latch release mechanism.

Numerous cabled electrical connectors exist that include a latch for locking the electrical connector to another electrical connector that is connected thereto. Some known latches include a hook portion that interconnects with locking features on the other electrical connector. When the electrical connectors are connected, the hook portions engage the locking features to lock the electrical connectors together. To unlock the electrical connectors, the latch may be manually operated to disengage the hook portions from the locking features. One or both of the electrical connectors can then be longitudinally moved to disconnect them from one another. To manually operate the latch, some electrical connectors include an actuating mechanism that extends from the cabled electrical connector and is pulled in a direction generally opposite the other electrical connector to disengage the hook portions. Such actuating mechanisms are sometimes referred to as pull tabs. However, a location and/or size of the pull tab may be difficult to access, such as when the electrical connector is located inside a component or behind a component, such as a cabinet or computer. For example, sometimes it may be difficult to pull the pull tab in the correct direction and pulling in the wrong direction may cause torque on the components and could damage the components. Additionally, there may be inadequate space behind the electrical connector to access and pull the pull tab rearward.

A need remains for an electrical connector having an improved latch release mechanism.

BRIEF DESCRIPTION OF THE INVENTION

In one aspect, an electrical connector is provided that includes a housing having a mating end, a rear end opposite the mating end, and an exterior wall extending between the mating end and the rear end. The exterior wall includes a cavity extending between the mating and rear ends. A latch is held on the housing and at least partially received in the cavity. The latch is configured to interact with a mating component to secure the housing to the mating component. A latch actuator is at least partially received in the cavity. The latch actuator has a first release mechanism and a second release mechanism. The first release mechanism includes a pull tab being linearly movable within the cavity during a pull release operation for interacting with the latch to release the latch during the pull release operation. The second release mechanism includes a push button being movable within the cavity during a push release operation for interacting with the latch to release the latch during the push release operation.

In another aspect, an electrical connector is provided including a housing having a mating end, a rear end opposite the mating end, and an exterior wall at a top of the housing extending between the mating end and the rear end. The exterior wall has a cavity below the exterior wall. A latch is held on the top of the housing and at least partially received in the cavity. The latch is configured to interact with a mating component to secure the housing to the mating component. The latch is depressible in a downward direction. A latch actuator is at least partially received in the cavity. The latch actuator has a first release mechanism and a second release mechanism. The first release mechanism includes a pull tab above the latch. The pull tab is linearly movable within the cavity during a pull release operation. The pull tab has a ramp interacting with the latch to depress the latch in the downward direction to release the latch during the pull release operation. The second release mechanism includes a push button above the latch. The push button is movable within the cavity during a push release operation. The push button interacts with the latch to depress the latch in the downward direction to release the latch during the push release operation.

In a further aspect, an electrical connector is provided including a housing having a mating end, a rear end opposite the mating end, and an exterior wall at a top of the housing extending between the mating end and the rear end. The exterior wall includes a cavity below the exterior wall. A latch is held on the top of the housing and at least partially received in the cavity. The latch is configured to interact with a mating component to secure the housing to the mating component. The latch is depressible in a downward direction. A latch actuator is at least partially received in the cavity. The latch actuator has a first release mechanism and a second release mechanism integral with the first release mechanism. The first release mechanism is actuatable in a first actuation direction during a first release operation to depress the latch in the downward direction to release the latch. The second release mechanism is actuatable in a second actuation direction different than the first actuation direction during a second release operation to depress the latch in the downward direction to release the latch.

DETAILED DESCRIPTION OF THE INVENTION

Figure 1:
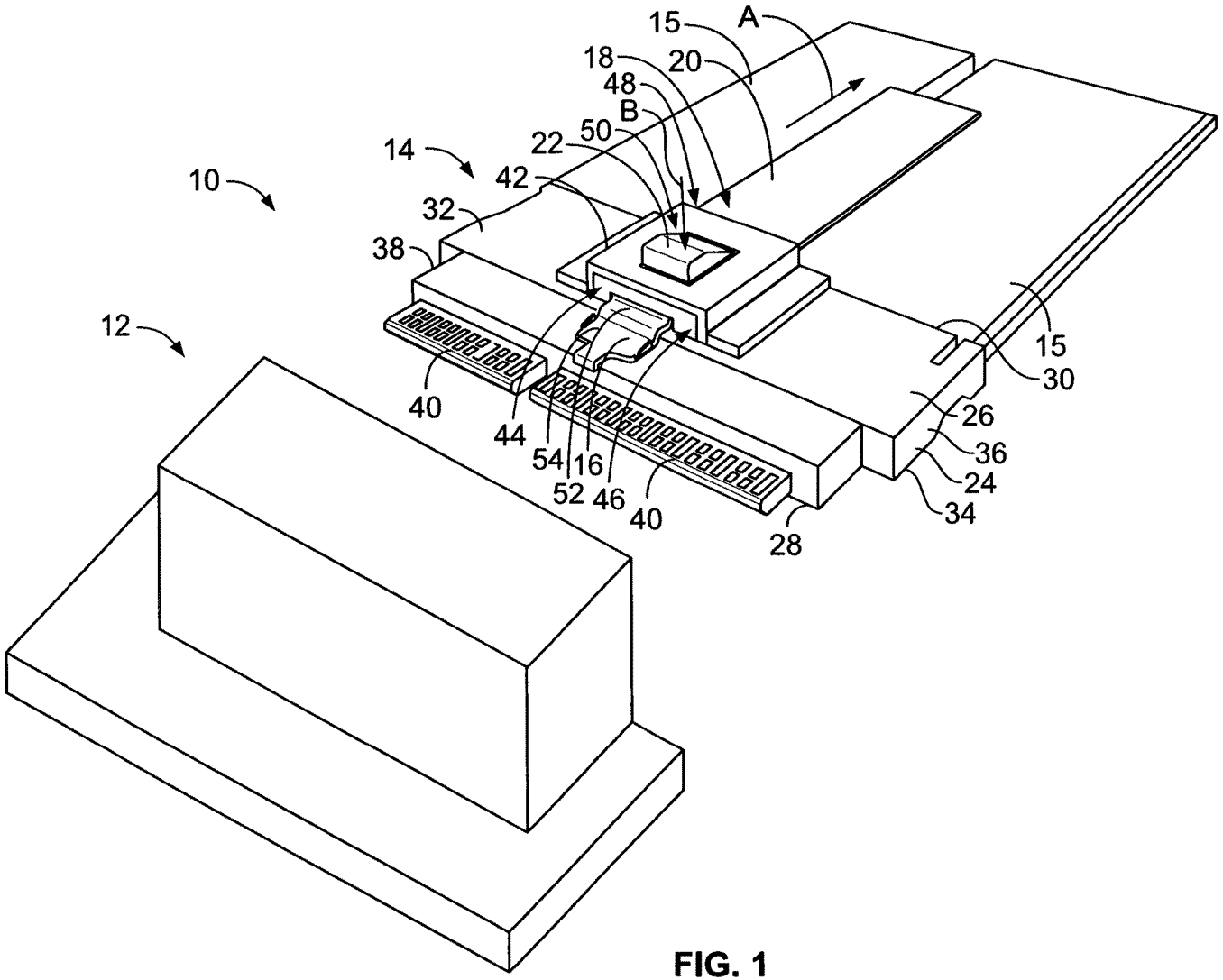
FIG. 1 is a perspective view of an electrical connector assembly including an electrical connector formed in accordance with an embodiment.

FIG. 1 is a perspective view of an electrical connector assembly 10 formed in accordance with an exemplary embodiment. The connector assembly 10 includes a pair of mating components, which are illustrated in the form of electrical connectors 12, 14 that are configured to be electrically connected to one another. For example, the electrical connector 12 is a receptacle connector 12 and the electrical connector 14 is a plug connector 14. In the illustrated embodiment, the mating component 12 is mounted to a circuit board; however the mating component may be provided at an end of a cable in other various embodiments. In the illustrated embodiment, the electrical connector 14 is provided at an end of a cable 15; however, the electrical connector 14 may be mounted to a circuit board in other various embodiments.

The electrical connector 14 includes a latch 16 for locking the connectors 12 and 14 together when they are connected. The electrical connector 14 includes a latch actuator 18 for actuating the latch 16 from a latched or closed position, wherein the connectors 12, 14 are held in a mated condition, to an unlatched or open position that allows the connectors 12 and 14 to be unmated. For example, the latch 16 may be depressed (for example, downward) to release the latch 16.

In an exemplary embodiment, the latch actuator 18 has multiple release mechanisms 20, 22 defining a dual actuatable latch actuator. The first release mechanism 20 is actuatable in a first actuation direction during a first release operation to depress the latch 16 to release the latch 16. The second release mechanism 22 is actuatable in a second actuation direction different than the first actuation direction during a second release operation to depress the latch 16 to release the latch 16. In the illustrated embodiment, the first release mechanism 20 is a pull tab and may be referred to hereinafter as a pull tab 20, while the second release mechanism 22 is a push button 22 and may be referred to hereinafter as a push button 22. The pull tab 20 is configured to be linearly actuated during a pull release operation, such as in the direction of arrow A, whereas the push button is configured to be actuated in a different direction during a push release operation, such as in the direction of arrow B.

The electrical connector 14 includes a housing 24 having a body 26 extending between a mating end 28 and a rear end 30 opposite the mating end 28. The cable 15 extends from the rear end 30. The housing body 26 includes a top 32, a bottom 34 and sides 36, 38 between the top 32 and the bottom 34. The housing body 26 defines a housing cavity (not shown) within the housing 24. One or more interface components, such as, but not limited to printed circuit boards 40, are held within the housing cavity for interfacing with one or more interface components (not shown), such as, but not limited to, electrical contacts, of the electrical connector 12. In the illustrated embodiment, the printed circuit board(s) 40 extend outward from the housing cavity at the mating end 28. The housing 24 may include one or more guide features to guide mating of the electrical connector 14 with the electrical connector 12. Although the housing 24 is shown as having a generally rectangular box shape, the housing 24 may have any shape.

The housing 24 includes an exterior wall 42 at the top 32 that defines a shroud forming a cavity 44 for the latch 16 and the latch actuator 18. The exterior wall 42 extends at least partially between the mating end 28 and the rear end 30 of the housing 24. Optionally, the exterior wall 42 may be discrete from the housing 24 and coupled thereto, such as using adhesive, fasteners, and the like. Alternatively, the exterior wall 42 may be integral with the housing 24, such as with a portion of the housing body 26 defining the exterior wall 42.

The cavity 44 includes a front opening 46 at the front for receiving the latch 16. The cavity 44 includes a rear opening 48 at the rear for receiving a portion of the latch actuator 18, such as the pull tab 20. The cavity 44 includes a top opening 50 at the top for receiving a portion of the latch actuator 18, such as the push button 22. The cavity 44 is sized and shaped to receive at least a portion of the pull tab 20 such that the pull tab 20 is linearly movable therein, as will be described in more detail below. The cavity 44 is sized and shaped to receive at least a portion of the push button 22 such that the push button is movable therein, as will be described in more detail below. A portion of the latch 16 is received in the cavity 44, such as through the front opening 46. For example, an actuation end 52 of the latch 16 is received in the cavity 44. A portion of the latch 16 may be exposed forward of the cavity 44 for interfacing with the electrical connector 12. For example, a latching end 54 of the latch 16 is forward of the exterior wall 42.

Figure 2:
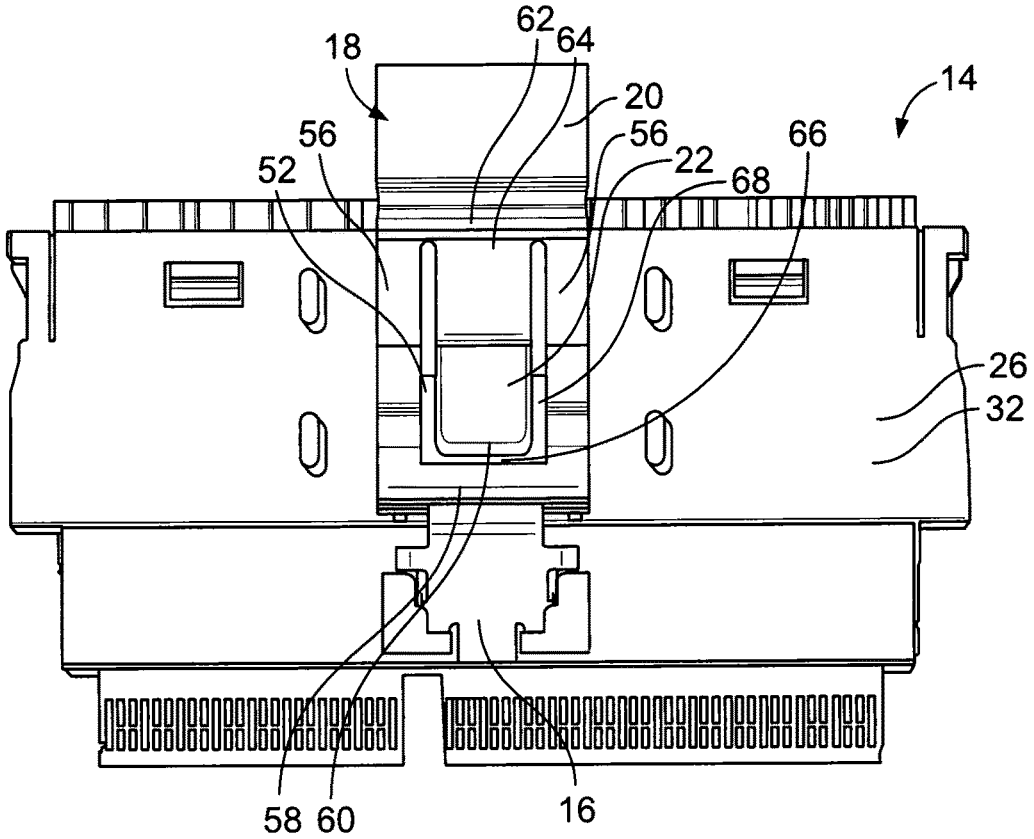
FIG. 2 is a top view of a portion of the electrical connector showing a latch actuator relative to a latch.

FIG. 2 is a top view of a portion of the electrical connector 14 with the exterior wall 42 (shown in FIG. 1) removed to illustrate the latch actuator 18 relative to the latch 16. In the illustrated embodiment, the push button 22 is integral with the pull tab 20. For example, the push button 22 and the pull tab 20 are co-molded together from a plastic material. The push button 22 is centrally located within the pull tab 20 with the pull tab 20 having arms 56 flanking both sides of the push button 22 and a cross beam 58 extending across a front 60 of the push button 22. As such, the push button 22 is surrounded by the pull tab 20 with the push button 22 being insert in the pull tab 20. The push button 22 may be cantilevered from the pull tab 20 at a hinge 62, such as at a rear end 64 of the push button 22. The push button 22 may be pivotable about the hinge 62 during the push release operation.

The latch actuator 18 extends over the actuation end 52 of the latch 16 and is used to depress the latch 16 downward toward the top 32 of the housing body 26. For example, the pull tab 20 is positioned above a portion of the latch 16 and the push button 22 is positioned above another portion of the latch 16. For example, the pull tab 20 may extend over an outer portion of the latch 16 and the push button 22 may extend over a central portion of the latch 16. In the illustrated embodiment, the actuation end 52 has a central body 66 and tabs 68 flared outward from opposite sides of the central body 66. The push button 22 is aligned with and engages the central body 66 to depress the latch 16 during the push release operation. The pull tab 22 (for example, the arms 56) is aligned with and engages the tabs 68 to depress the latch 16 during the pull release operation.

Figure 3:
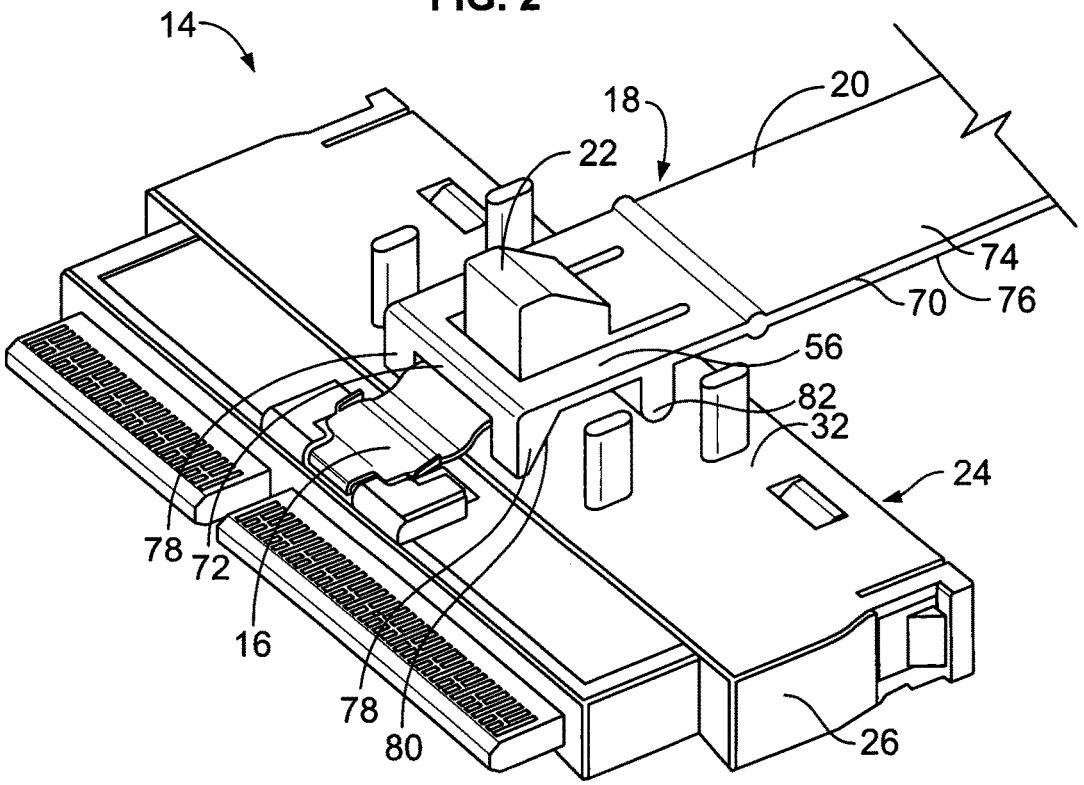
FIG. 3 is a perspective view of a portion of the electrical connector showing the latch actuator relative to the latch.

FIG. 3 is a perspective view of a portion of the electrical connector 14 with the exterior wall 42 (shown in FIG. 1) removed to illustrate the latch actuator 18 relative to the latch 16. The pull tab 20 includes a pull tab body 70 extending to an end 72. The pull tab 20 has a top 74 and a bottom 76 opposite the top 74. The push button 22 is shown extending upward above the top 74 of the pull tab 20, such that the push button 22 may be exposed above the exterior wall 42. The pull tab 20 includes ramps 78 extending from the bottom 76, such as from the arms 56. In the illustrated embodiment, the ramps 78 are provided at or near the end 72. The arms 56 of the pull tab 20 are positioned above the latch 16 with the ramps 78 forward of the tabs 68 (FIG. 2) of the latch 16 to interact with the latch 16 as the pull tab 20 is pulled rearward during the pull release operation. For example, angled or ramped surfaces 80 of the ramps 78 engage the tabs 68 to drive the latch downward as the pull tab 20 is pulled rearward during the pull release operation. Optionally, the tips of the ramps 78 may rest on the top 32 of the housing body 26, such as to support the latch actuator 18. For example, the ramps 78 may support the latch actuator 18 when the push button 22 is pushed downward.

In an exemplary embodiment, the latch actuator 18 includes travel limits 82 extending downward from the bottom 76. The travel limits 82 limit a range of motion over which the pull tab 20 moves relative to the housing 24. For example, the travel limits 82 may interact with other travel limits of the housing 24 or the exterior wall 42. The travel limits of the housing 24 may have any suitable configuration, arrangement, orientation, position, and/or location, and/or may include any structure and/or means, that enable the travel limits to function to limit travel of the pull tab 20. Optionally, the tips of the travel limits 82 may rest on the top 32 of the housing body 26, such as to support the latch actuator 18. For example, the travel limits 82 may support the latch actuator 18 when the push button 22 is pushed downward.

Figure 4:
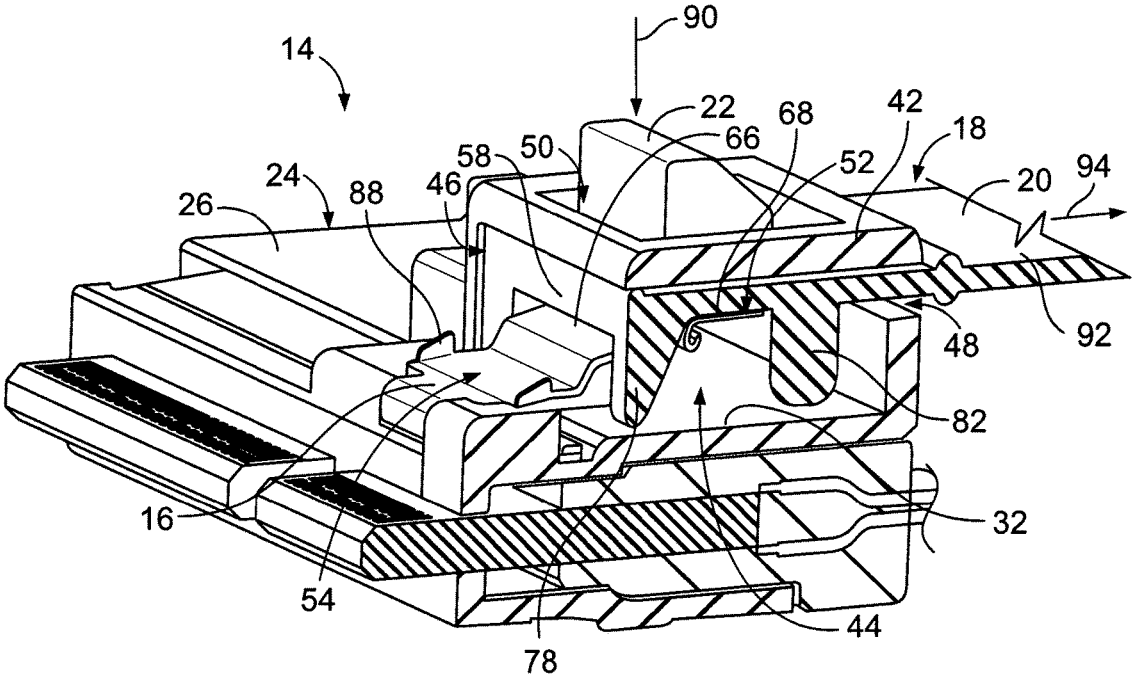
FIG. 4 is a partial sectional view of the electrical connector showing the latch actuator and the latch.
Figure 5:
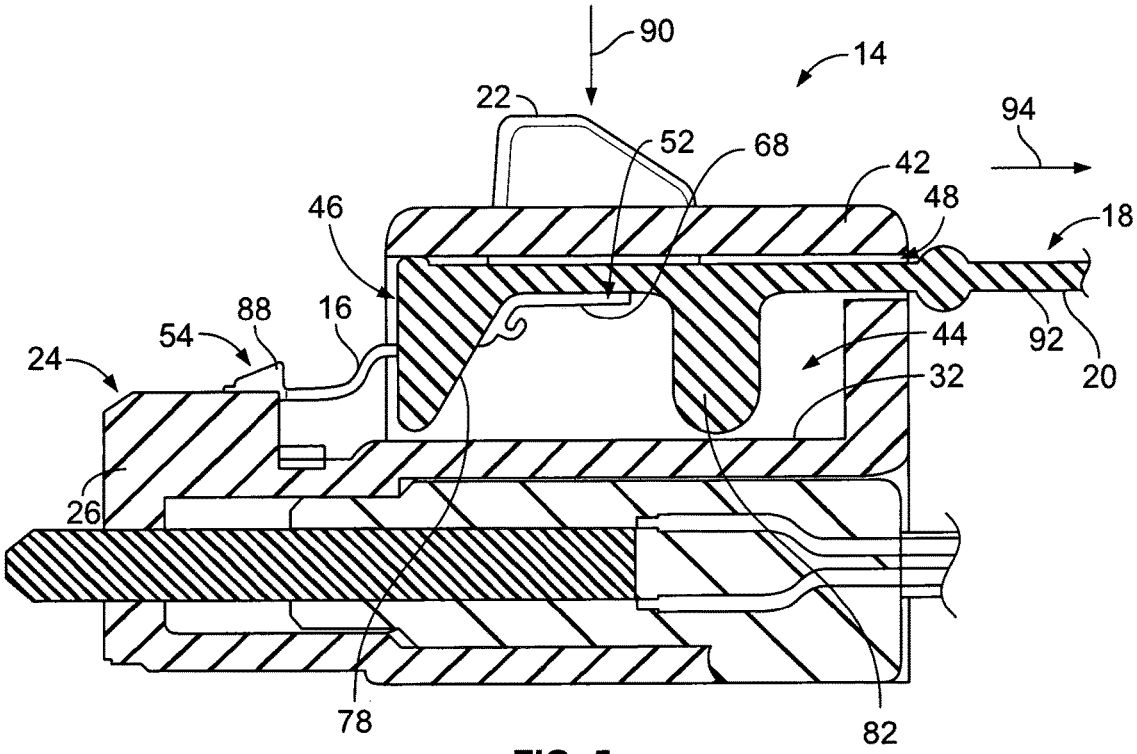
FIG. 5 is a cross-sectional view of the electrical connector showing the latch actuator and the latch.

FIG. 4 is a partial sectional view of the electrical connector 14 showing the latch actuator 18 and the latch 16. FIG. 5 is a cross-sectional view of the electrical connector 14 showing the latch actuator 18 and the latch 16. The latching end 54 of the latch 16 is forward of the exterior wall 42 and includes hook portions 88 configured to latch to the mating component 12 (shown in FIG. 1). The actuation end 52 extends into the cavity 44, such as through the front opening 46, and is positioned below the latch actuator 18. The latch 16 may pass between the ramps 78, such as below the cross beam 58. The latch actuator 18 is located within the cavity 44 to interact with the latch 16.

The push button 22 passes through the top opening 50 and is accessible above the exterior wall 42. The push button 22 may be pressed downward from above the latch actuator 18 in an actuation direction 90, forcing the push button 22 downward into the cavity 44. Pressing of the push button 22 during the push release operation causes the push button 22 to move relative to the pull tab 20 to engage and depress the latch 16 downward toward the top 32 of the housing body 26. The push button 22 may be pivoted relative to the pull tab 20, such as about the hinge 62 (shown in FIG. 2) in a downward direction toward the latch 16 to depress the latch 16 during the push release operation. The push button 22 is driven into the central body 66 to depress the latch 16.

The pull tab 20 includes a handle 92 at the back end thereof extending rearward of the push button 22. The handle 92 of the pull tab 20 extends through the rear opening 48 and is accessible behind the exterior wall 42. The ramps 78 and/or the travel limits 82 and/or a wall defining the rear opening 48 supports the pull tab 20 and may guide movement of the pull tab 20. The pull tab 20 may be pulled rearward from behind the housing 24 in an actuation direction 94. The push button 22, being connected to the pull tab 20, is moveable with the pull tab 20 during the pull release operation. The actuation direction 94 is different than the actuation direction 90 (for example, horizontal versus vertical, respectively, or linear versus rotating, respectively). The pull tab 20 is positioned above the latch 16 with the ramps 78 forward of the latch 16 to interact with the latch 16 during the pull release operation. Pulling of the pull tab 20 during the pull release operation drives the ramps 78 rearward into the tabs 68 of the latch 16, causing the latch 16 to depress downward toward the top 32 of the housing body 26. The pull tab 22 is linearly movable in the rearward actuation direction 94 to drive the ramps 78 into the latch 16. The travel limits 82 cooperate with the housing 24 to define a range of motion over which the pull tab 20 moves within the cavity 44. For example, the travel limits 82 may engage the rear wall of the exterior wall 42 to limit rearward movement of the latch actuator 18 or may engage other features of the housing 24. Optionally, the rear end of the push button 22 may define a travel limit configured to cooperate with the portion of the exterior wall 42 defining the rear edge of the top opening 50.

The embodiments described herein provide a dual-actuation latch actuator that may be actuated in different manners and directions to unlatch an electrical connector from another connector. The latch actuator includes both a pull tab for actuating the latch and a push button for actuating the latch. The pull tab and latch may be reliable, durable, and/or less complex than other known connectors. The use of the same latch actuator to actuate the latch in different manners provides ease of use and may allow unlatching in difficult to access or difficult to see locations.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a mating end, a rear end opposite the mating end, and an exterior wall extending at least partially between the mating end and the rear end, the exterior wall including a cavity extending between the mating and rear ends;

a latch held on the housing and at least partially received in the cavity, the latch being configured to interact with a mating component to secure the housing to the mating component;

a latch actuator at least partially received in the cavity, the latch actuator having a first release mechanism and a second release mechanism, the first release mechanism comprising a pull tab being linearly movable within the cavity during a pull release operation, the pull tab interacting with the latch to release the latch during the pull release operation, the second release mechanism comprising a push button being movable within the cavity during a push release operation, the push button interacting with the latch to release the latch during the push release operation.

2. The electrical connector of claim 1, wherein the push button is integral with the pull tab.

3. The electrical connector of claim 1, wherein the pull tab is actuatable in a first actuation direction during the pull release operation to depress the latch downward to release the latch, and wherein the push button is actuatable in a second actuation direction different than the first actuation direction during the push release operation to depress the latch in the downward direction to release the latch.

4. The electrical connector of claim 1, wherein the pull tab includes a pull tab body having a top and a bottom, the pull tab including a ramp extending from the bottom, the pull tab being positioned above the latch with the ramp being forward of the latch to interact with the latch as the pull tab is pulled rearward during the pull release operation.

5. The electrical connector of claim 1, wherein the push button is cantilevered from the pull tab at a hinge, the push button being pivoted about the hinge in a downward direction toward the latch to depress the latch during the push release operation.

6. The electrical connector of claim 1, wherein the exterior wall includes a top opening, the push button extending through the top opening above the exterior wall, the push button being depressible into the cavity to depress the latch during the push release operation.

7. The electrical connector of claim 1, wherein the pull tab supports the push button above the latch.

8. The electrical connector of claim 1, wherein the push button is moveable with the pull tab during the pull release operation.

9. The electrical connector of claim 1, wherein the push button and the pull tab engage different portions of the latch to depress the latch.

10. The electrical connector of claim 1, wherein the latch includes a latching end and an actuation end, the latching end being configured to latch to the mating component, the actuation end having a central body and a tab extending outward from the central body, the push button being aligned with and engaging the central body to depress the latch during the push release operation, the pull tab being aligned with and engaging the tab to depress the latch during the pull release operation.

11. The electrical connector of claim 1, further comprising travel limits provided on the pull tab and within the cavity, the travel limits cooperating with the housing to define a range of motion over which the pull tab moves within the cavity.

12. The electrical connector of claim 1, wherein the rear end of the housing comprises a rear opening configured to receive an electrical cable.

13. The electrical connector of claim 1, wherein the housing holds a printed circuit board configured for mating with the mating component.

14. An electrical connector comprising:

a housing having a mating end, a rear end opposite the mating end, and an exterior wall at a top of the housing extending at least partially between the mating end and the rear end, the exterior wall including a cavity below the exterior wall;

a latch held on the top of the housing and at least partially received in the cavity, the latch being configured to interact with a mating component to secure the housing to the mating component, the latch being depressible in a downward direction;

a latch actuator at least partially received in the cavity, the latch actuator having a first release mechanism and a second release mechanism, the first release mechanism comprising a pull tab above the latch, the pull tab being linearly movable within the cavity during a pull release operation, the pull tab having a ramp interacting with the latch to depress the latch in the downward direction to release the latch during the pull release operation, the second release mechanism comprising a push button above the latch, the push button being movable within the cavity during a push release operation, the push button interacting with the latch to depress the latch in the downward direction to release the latch during the push release operation.

15. The electrical connector of claim 14, wherein the pull tab is actuatable in a first actuation direction during the pull release operation to depress the latch downward to release the latch, and wherein the push button is actuatable in a second actuation direction different than the first actuation direction during the push release operation to depress the latch in the downward direction to release the latch.

16. The electrical connector of claim 14, wherein the pull tab includes a pull tab body having a top and a bottom, the pull tab including a ramp extending from the bottom, the pull tab being positioned above the latch with the ramp being forward of the latch to interact with the latch as the pull tab is pulled rearward during the pull release operation.

17. The electrical connector of claim 14, wherein the push button is cantilevered from the pull tab at a hinge, the push button being pivoted about the hinge in a downward direction toward the latch to depress the latch during the push release operation.

18. The electrical connector of claim 14, wherein the exterior wall includes a top opening, the push button extending through the top opening above the exterior wall, the push button being depressible into the cavity to depress the latch during the push release operation.

19. The electrical connector of claim 14, wherein the push button and the pull tab engage different portions of the latch to depress the latch.

20. An electrical connector comprising:

a housing having a mating end, a rear end opposite the mating end, and an exterior wall at a top of the housing extending at least partially between the mating end and the rear end, the exterior wall including a cavity below the exterior wall;

a latch held on the top of the housing and at least partially received in the cavity, the latch being configured to interact with a mating component to secure the housing to the mating component, the latch being depressible in a downward direction;

a latch actuator at least partially received in the cavity, the latch actuator having a first release mechanism and a second release mechanism integral with the first release mechanism, the first release mechanism being actuatable in a first actuation direction during a first release operation to depress the latch in the downward direction to release the latch, the second release mechanism being actuatable in a second actuation direction different than the first actuation direction during a second release operation to depress the latch in the downward direction to release the latch.

* * * * *